US007377198B2

(12) United States Patent
Picone

(10) Patent No.: US 7,377,198 B2
(45) Date of Patent: May 27, 2008

(54) POWERED ADJUSTABLE WRENCH

(75) Inventor: John A. Picone, Oceanside, NY (US)

(73) Assignee: Picone Products, Inc., Oceanside, NY (US)

( * ) Notice: Subject to any disclaimer, the term of this patent is extended or adjusted under 35 U.S.C. 154(b) by 17 days.

(21) Appl. No.: 11/651,622

(22) Filed: Jan. 10, 2007

(65) Prior Publication Data

US 2007/0157767 A1 Jul. 12, 2007

Related U.S. Application Data

(60) Provisional application No. 60/757,485, filed on Jan. 10, 2006.

(51) Int. Cl.
*B25B 17/00* (2006.01)
*B25B 13/14* (2006.01)

(52) U.S. Cl. ..... 81/57.13; 81/165

(58) Field of Classification Search ..... 81/57.13, 81/165, 170

See application file for complete search history.

(56) References Cited

U.S. PATENT DOCUMENTS 4,512,221 A * 4/1985 Picone ..... 81/170
5,682,802 A * 11/1997 Mazzone ..... 81/127
6,477,921 B1 * 11/2002 Picone ..... 81/170
6,966,242 B2 * 11/2005 Picone ..... 81/165

* cited by examiner

*Primary Examiner*—David B Thomas
(74) *Attorney, Agent, or Firm*—Berenato, White & Stavish

(57) ABSTRACT

A powered adjustable jaw wrench comprises a wrench body having a handle portion and a head portion defining a stationary jaw, a movable jaw reciprocally mounted to the head portion, a driven mechanism operably connected to the movable jaw, and a drive mechanism mounted to the body member and including a power source and an indexing mechanism. The driven mechanism includes a worm driving the movable jaw and an indexing wheel operably connected to the worm gear. The indexing mechanism is driven by the power source and includes an oscillating pallet member. The pallet member incrementally drives the indexing wheel so as to convert an oscillating movement of the pallet member into an incremental rotatable movement of the indexing wheel.

40 Claims, 11 Drawing Sheets

Fig. 7
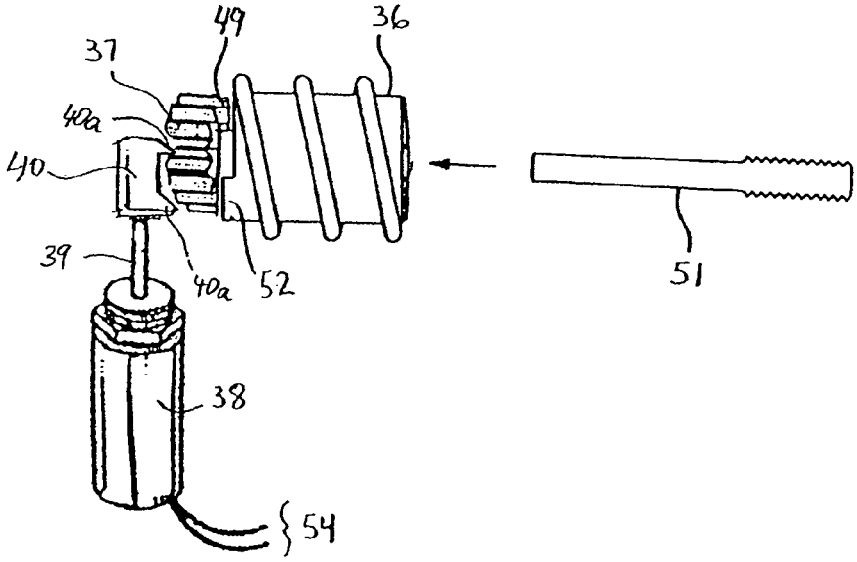
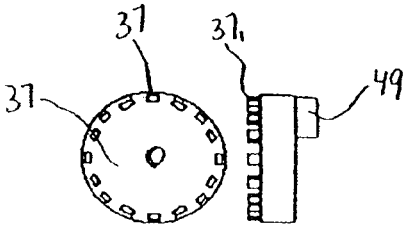
Fig. 7A
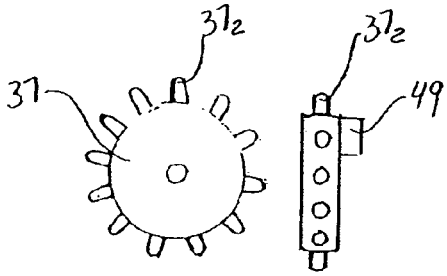
Fig. 7B
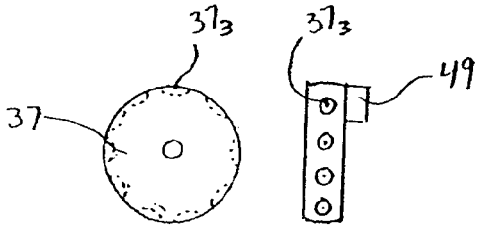
Fig. 7C

Fig. 8
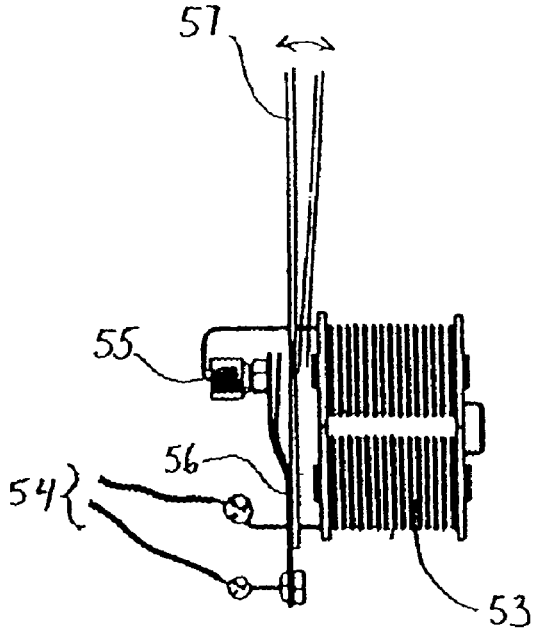
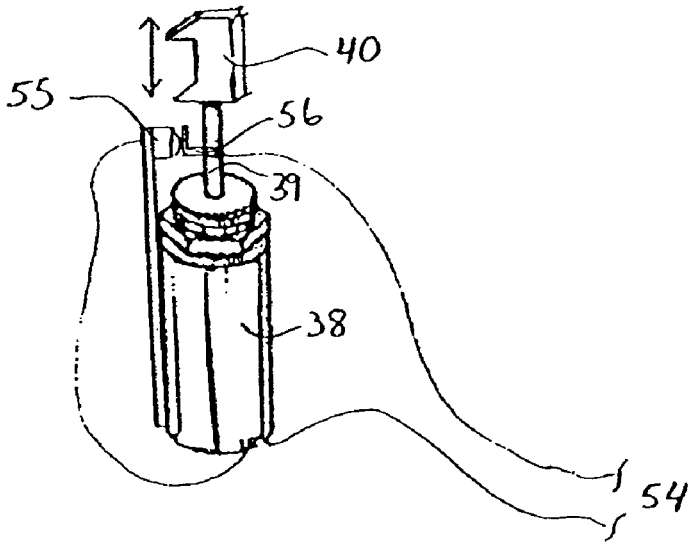
Fig. 9

POWERED ADJUSTABLE WRENCH

CROSS-REFERENCE TO RELATED APPLICATION

This Application claims the benefit under 35 U.S.C. 119(e) of U.S. Provisional Application No. 60/757,485 filed on Jan. 10, 2006 by John Picone.

BACKGROUND OF THE INVENTION

1. Field of the Invention

The present invention relates generally to wrenches and, more particularly, to a powered adjustable wrench having a sliding jaw.

2. Description of the Prior Art

A powered adjustable jaw wrench having a sliding jaw and a stationary jaw is known in the prior art. As illustrated in FIG. 1, the powered adjustable jaw wrench 10 of the prior art comprises a wrench body 11 including a wrench body member 12 provided with an integral stationary jaw 15, and a handle cover 16, a moveable jaw 17 adjustable relative to the stationary jaw 15. A handle portion 13 and a head portion 14 of the wrench body member 12 form a unitary single-piece part. A worm gear 19 and a sprocket 18 rotatable mounted in the head portion 14 of the wrench body member 12 coaxially with respect to each other. The worm gear 19 is operably connected to a toothed rack of the moveable jaw 17 so that the rotatable movement of the worm gear 19 is transformed into linear movement of the moveable jaw 17.

The prior art powered adjustable jaw wrench 10 further includes a drive mechanism, a motor 22, a sprocket 21, a drive belt 20, and control switch assembly 25, a switch actuator 26, and a power source 27 all housed in the unitary single-piece part wrench body member 12.

As further illustrated in FIG. 2, an exploded view of the prior art detailing the handle portion 13 and the head portion 14 of the wrench body member 12 form a unitary single-piece part. Wrench body member 12 is provided with compartment openings 22, 23 and 24 housing the electric motor 22, the control switch assembly 25 and the electric batteries 27, respectively.

However, the powered adjustable wrenches of the prior art suffer certain drawbacks when utilizing a motor with either pulleys or sprockets and a drive belt or chain respectively, to transmit power to the worm. Because of the friction and forces caused by utilizing belt and chain transmissions, the powered adjustable must be equipped with larger, high torque motors to compensate for the efficiency losses. Thus, prior art wrenches are designed around the motor dimensions and therefore the thickness and size of the wrench becomes dictated by the size of the motor. Prior art wrenches become limited by design to oversized motors to obtain the necessary torque to rotate the worm gear and overcome gravity and friction to carry the weight of the sliding jaw.

Furthermore, the powered adjustable wrenches of the prior art have motors that are not governed and presently experience motor overrun causing vicarious control when adjusting the wrench.

SUMMARY OF THE INVENTION

The present invention is an improvement over the adjustable jaw wrench of the prior art disclosed in U.S. Pat. No. 4,512,221, in 6,477,921 and in U.S. Pat. No. 6,166,242 incorporated herein by reference.

It is therefore an object of the present invention to provide for a novel and improved powered adjustable wrench that operates more efficiently and has improved control characteristics when adjusting the wrench.

The powered adjustable jaw wrench of the present invention comprises a wrench body including a wrench body member having a handle portion and a head portion defining a stationary jaw, a movable jaw reciprocally mounted to the head portion of the body member in alignment with the stationary jaw, a driven mechanism mounted to the head portion of the body member and operably connected to the movable jaw and causing movement of the movable jaw relative to the stationary jaw, and a drive mechanism mounted to the body member and including a power source and an indexing mechanism. The driven mechanism includes a worm gear rotatably mounted in the head portion of the body member, and an indexing wheel operably connected to the worm gear. The indexing mechanism is driven by the power source and includes an oscillating pallet member. The pallet member incrementally drives the indexing wheel so as to convert an oscillating movement of the pallet member into an incremental rotatable movement of the indexing wheel.

It will be appreciated by those skilled in the art that various types of the power source and indexing mechanism may be employed within the scope of the present invention.

BRIEF DESCRIPTION OF THE DRAWINGS

Other objects and advantages of the invention will become apparent from a study of the following specification when viewed in light of the accompanying drawings, wherein:

FIG. 7 is a side view of a drive mechanism of the powered adjustable wrench in accordance with the first embodiment of the present invention;

FIGS. 7A-7C show exemplary configurations of an indexing wheel in accordance with the present invention;

FIG. 8 is a side view of an electromagnet with a self-interrupting circuit;

FIG. 9 is a side view of a solenoid with a self-interrupting circuit;

DETAILED DESCRIPTION OF PREFERRED EMBODIMENTS

The preferred embodiments of the present invention will now be described with the reference to accompanying drawings.

Figure 1:
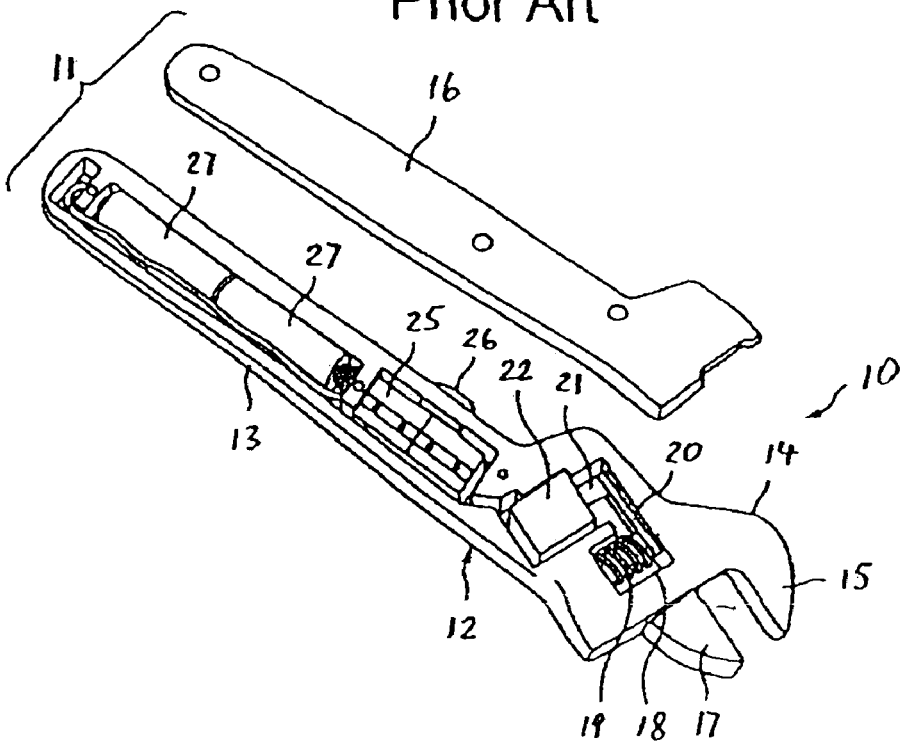
Fig. 1 Prior Art
FIG. 1 is a perspective view showing a powered adjustable jaw wrench of the prior art.
Figure 2:
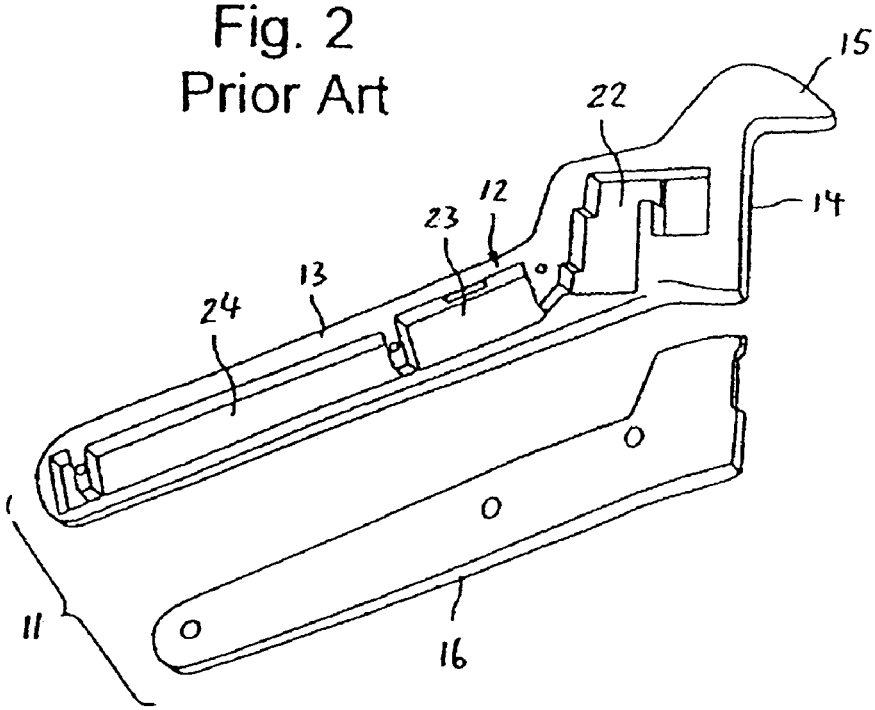
Fig. 2 Prior Art
FIG. 2 is an exploded perspective view of a wrench body of the powered adjustable jaw wrench of the prior art.
Figure 3:
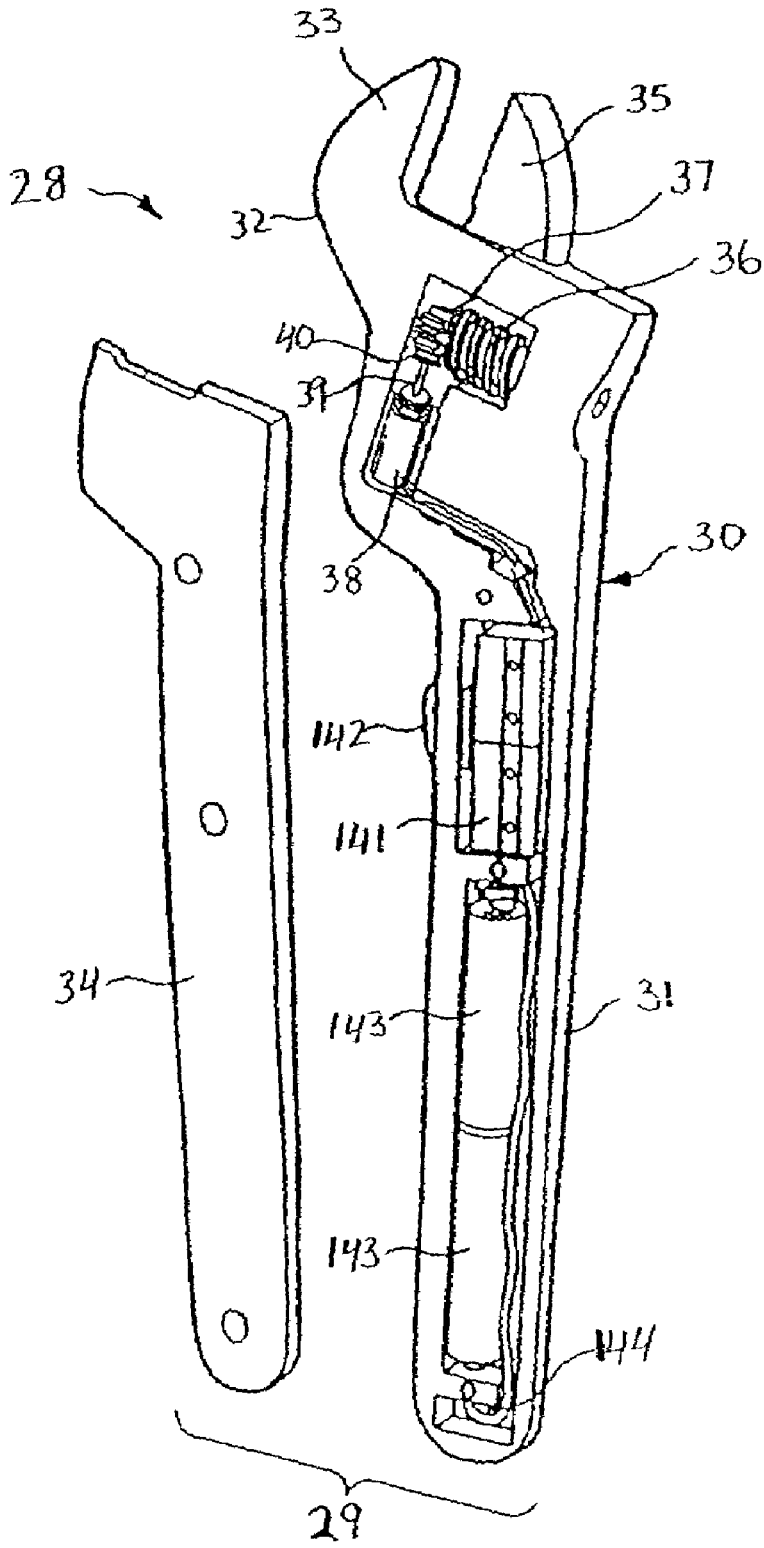
FIG. 3 is a perspective view showing a powered adjustable jaw wrench in accordance with the first embodiment of the present invention.
Figure 4:
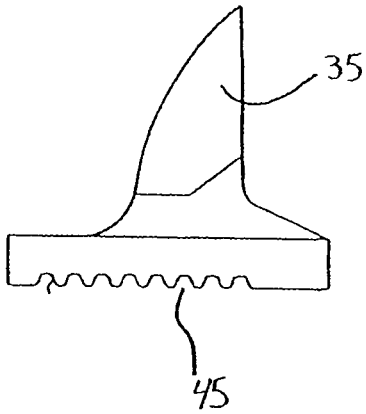
FIG. 4 is a side view of a moveable jaw.

Referring now to FIG. 3, an improved powered adjustable jaw wrench according to the first embodiment of the present invention illustrated generally at 28 and comprises a wrench body 29 including a wrench body member 30 provided with a stationery jaw 33, and a handle cover 34 removably fastened to the wrench body member 30, and a movable jaw 35 adjustable relative to the stationery jaw 33. The movable jaw 35 is formed integral with a toothed rack 45, as shown in FIG. 4. The wrench body member 30 includes a handle portion 31 and a head portion 32. The stationery jaw 33 is integral to the head portion 32. Preferably, the handle portion 31 and the head portion 32 of the wrench body member 30, illustrated further in detail in FIG. 5, form a unitary single-piece part. It will be appreciated by those skilled in the art that the wrench body member 30 may be made of any appropriate material such as metal (steel, aluminum, etc.) or plastic material. The metal wrench body member 30 may be manufactured, preferably, of stainless steel by forging. However, any other appropriate methods for manufacturing the wrench body member 30 made of metal, such as die-casting or punching from a metal plate, are within the scope of the present invention. The plastic wrench body member is manufactured, preferably, by injection molding. However, any other appropriate methods for manufacturing the wrench body member 30 made of plastic material well known in the prior art, are within the scope of the present invention.

Figure 6:
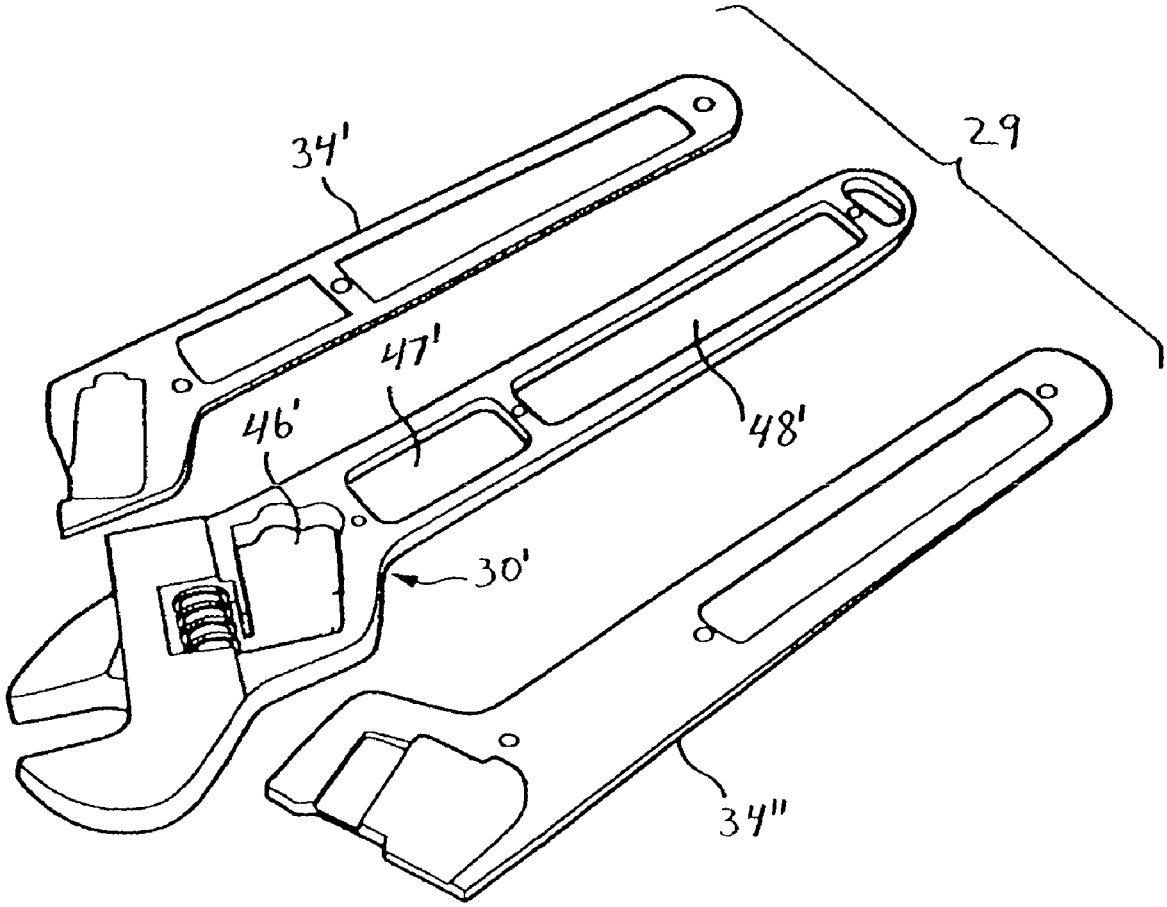
FIG. 6 is an exploded perspective view of the wrench body of the powered adjustable wrench in accordance with the second embodiment of the present invention.

In the modified version according to the second embodiment of the present invention, illustrated in FIG. 6, the wrench body 29 includes a unitary single-piece wrench body member 30' and a pair of opposite handle covers 34' and 34" removably fastened to the wrench body member 30', preferably by bolts or screws.

The powered adjustable jaw wrench 28 according to the present invention further includes a driven mechanism comprising a worm gear 36 and a first rotatable member both rotatably mounted in the head portion 32 of the wrench body member 30 coaxially with respect to each other. The worm gear 36 is operably connected to the toothed rack 45 of the movable jaw 35 so that the rotatable movement of the worm gear 36 is transformed into the linear movement of the movable jaw 35. In the first embodiment of the present invention, as illustrated in FIGS. 3 and 7, the first rotatable member is in the form of a first toothed indexing wheel 37 mounted on a stationary shaft 51 coaxially relative to the worm gear 36. The stationary shaft 51 is mounted in the head portion 32 of the wrench body member 30. As illustrated in FIG. 7 worm gear 36 and indexing wheel 37 are drivingly engaged to each other by drive keys 52 and 49 respectively.

The powered adjustable jaw wrench 28 according to the present invention further includes a drive mechanism having a power source and an indexing mechanism driven by the power source. In accordance with the first embodiment of the present invention, illustrated in FIG. 3 and 7, the drive mechanism comprises an electric solenoid 38 mounted in the handle portion 31, whereas the electric solenoid 38 incorporates a laterally flexible shaft plunger 39. The indexing mechanism includes a first wheel-indexing member. Accordance to the first embodiment of the present invention, the first wheel-indexing member is in the form of an oscillating first pallet member 40 having ratchet-like teeth **40*a* and drivingly connected to the shaft plunger 39 at a distal end thereof. The electric solenoid 38 is employed to create reciprocating (oscillating) linear activation (motion) of the shaft plunger 39, whereas the teeth 40*a* of the first pallet member 40 engage the first toothed indexing wheel 37 by indexing the first toothed indexing wheel 37, whereas continuous indexing results in rotating of the indexing wheel 37 and whereas indexing wheel 37 is drivingly engaged to rotate worm gear 37**.

Specifically, during a pull linear stroke of the solenoid 38 (such as, for example, when the solenoid 38 is activated), the teeth **40*a* of the first pallet member 40 engage teeth of the first indexing wheel 37 and turn the first indexing wheel 37 to a certain predetermined angle. However, during a push stroke of the solenoid 38 (such as, for example, when the solenoid 38 is deactivated), the ratchet-like teeth 40*a* of the first pallet member 40 slip out of engagement with the teeth of the first indexing wheel 37 due to the lateral flexibility of the shaft plunger 39 and the ratchet-like shape of the teeth 40*a* of the first pallet member 40, as would be readily understood by those skilled in the art. As a result, the first indexing wheel 37 does not rotate during the push (upward) stroke of the solenoid 38. It would be appreciated that other lost motion mechanisms known in the art may be used to provide rotation of the first indexing wheel 37 during the linear motion of the first pallet member 40 in only one direction, and prevent rotation thereof during the reverse motion of the first pallet member 40**.

Therefore, in operation of the powered adjustable jaw wrench 28, the oscillating first pallet member 40 incrementally (or intermittently) drives the first indexing wheel 37 so as to convert an oscillating movement of the first pallet member 70 into an incremental rotatable movement of the first indexing wheel 37 and, hence, the worm gear 36.

As disclosed hereinabove, the reciprocating linear motion of the first pallet member 40 turns the first indexing wheel 37 in only one direction, this either closing or opening the adjustable jaw wrench 28. Evidently, in order to turn the first indexing wheel 37 in opposite direction, a second pallet member has to be provided.

Figure 5:
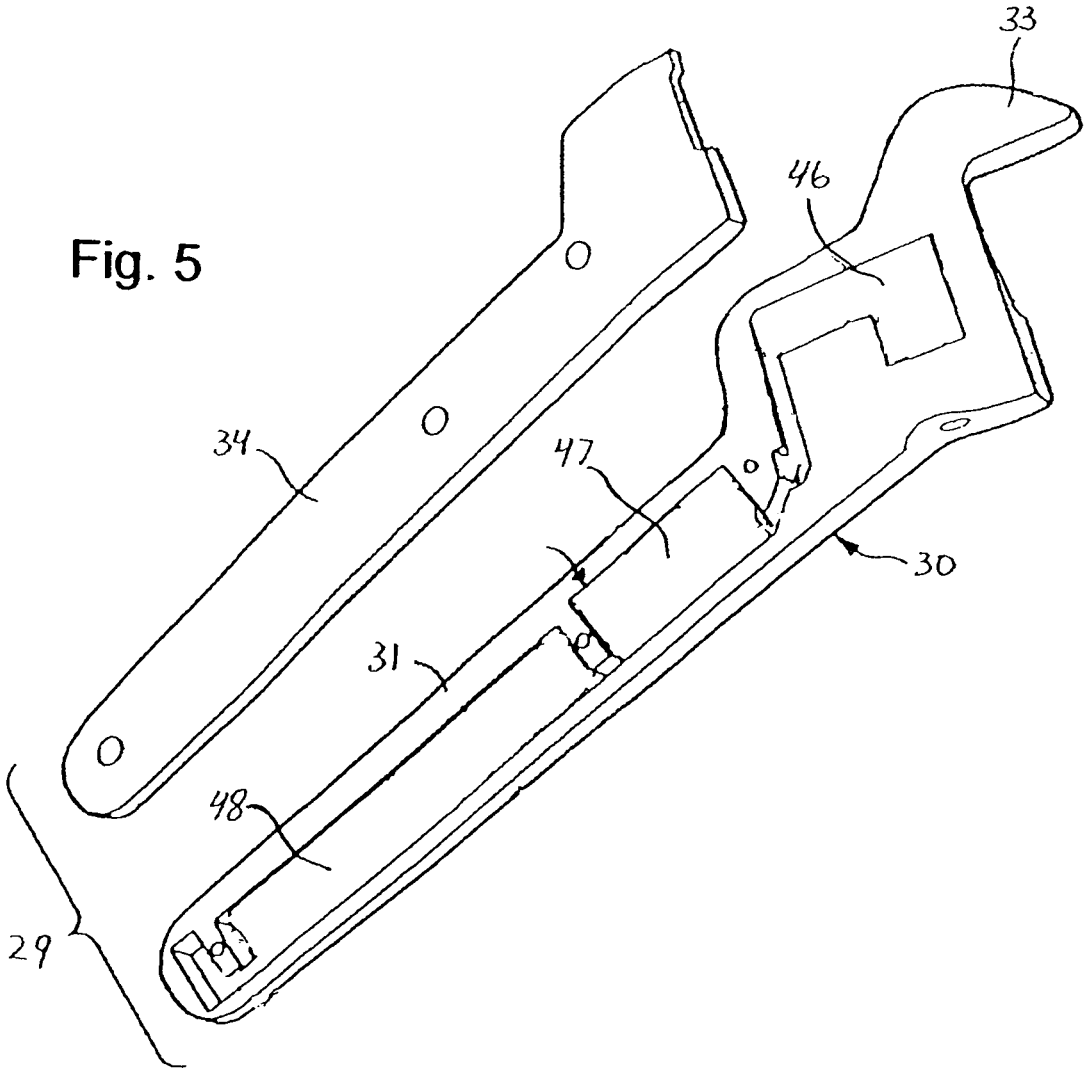
FIG. 5 is an exploded perspective view of a wrench body of the powered adjustable wrench in accordance with the first embodiment of the present invention.

As further illustrated in FIG. 3, the electric solenoid 38 is electrically connected to a control switch assembly 141 including a switch actuator 142, controlling the solenoid 38 and at least one electric battery 143 supplying electric power to the solenoid 38 and the control switch assembly 141. Preferably, two batteries 143 are provided. The batteries 143 may be rechargeable. In this case, a DC power jack 144 is used for recharging the batteries 143. The electric solenoid 38, the control switch assembly 141 and the electric battery 143 are disposed in compartments 46,47 and 48 respectively, formed in the handle portion 31 of the wrench body member 30, as illustrated in FIG. 5. The handle cover 34 is adapted to seal the compartments 46, 47 and 48.

In accordance with the second embodiment of the present invention, illustrated in FIG. 6, the wrench body member 30 is provided with through openings 46', 47' and 48' housing the electric solenoid 38, the control switch assembly 141 and the electric battery 143, respectively.

Figure 23:
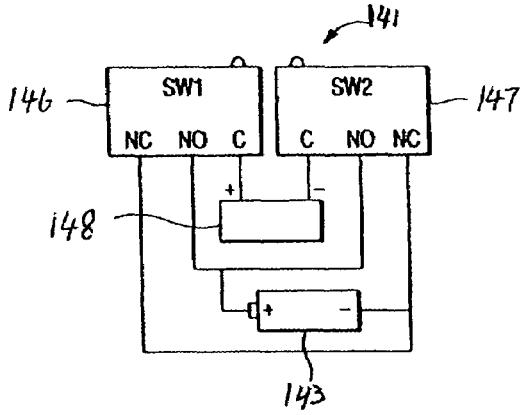
FIG. 23 is a schematic diagram of an electric circuitry for the powered adjustable wrench in accordance with the present invention.

It will be appreciated that any appropriate type of electrical switches known in the prior art may be utilized in the present invention, such as a double pole double throw (DPDT) switch. Preferably, the control switch assembly 141 includes a pair of single pole double throw (SPDT) switches 146 and 147 and the switch actuator 142. It will be further appreciated that the electrical circuit at FIG. 23 can universally control the function of a solenoid, an electromagnet or a motor at output wires 148 in accordance with the present invention.

In accordance with the present invention, various indexing wheel configurations can be utilized in conjunction with the linear indexing power source. Shown in FIG. 7A is a first indexing wheel 37 comprising of teeth or pegs $\mathbf{37}_1$ formed on a crown and having an integral drive key 49. Alternately, shown in FIG. 7B is an indexing wheel 37 comprising teeth or pegs $\mathbf{37}_2$ and shown in FIG. 7C is an indexing wheel 37 comprising of recesses (or detents) $\mathbf{37}_3$ formed on the outer diameter of the first indexing wheel 37.

In accordance with the first embodiment of the present invention, the linear indexing power source can be provided from various types of an electromagnet 53 of FIG. 8 or the solenoid 38 of FIG. 9. Both the electromagnet 53 and solenoid 38 can operate with a push or pull linear stroke depending on the configuration and the way electric current is applied. Furthermore, the electromagnet 53 and solenoid 38 can be configured to operate to a single-intermittent stroke or configured to operate with multiple continuous strokes depending on how the circuit is designed.

Therefore, it will be appreciated by those skilled in the art that they can adapt these principals to the present invention and create a powered adjustable wrench with single-incremental displacement (indexing) with either push or pull performance or a combination thereof, and similarly, one could create a powered adjustable wrench with multiple continuous incrementally indexing with either push or pull performance or a combination thereof An example of a continuous circuit that can be utilized to provide continuous indexing is shown in FIG. 8. Whereas, FIG. 8 consists of an electromagnet 53, a contact 55, a contact arm 56, spring blade 57 and power input wires 54. Now, when you start out contact 55 is closed and the contact arm 56 and the spring blade 57 are in the pulled-back position. With electric current supplied to input wires 54, the electric current flows through contact 55, down the contact arm 56, into the coil of the electromagnet 53 and back to the power source battery 43. In other words, electricity can flow through the electromagnet when the circuit is closed. The contact arm 56 and the spring blade 57 get pulled down, breaking the circuit. Current stops flowing when contact 55 opens up and the circuit is broken. Tension of the spring blade 57 pulls the contact arm 56 back. When the contact arm 56 moves back, the contact 55 closes again and the whole process starts all over again. In this way the electromagnet keeps shutting itself on and off and the process repeats itself as long as current is supplied. In this case the linear movement of the spring blade 57 is utilized to perform the indexing of the indexing wheel 37.

Another example of a continuous circuit that can be utilized to provide continuous indexing is shown in FIG. 9. Whereas, shown in FIG. 9 is of the solenoid 38, a contact 55, a contact arm 56, the shaft plunger 39, the first pallet member 40 and power input wires 54. Initially, the contact 55 is closed and engaged with the contact arm 56. With electric current supplied to input wires 54, the electric current flows through the contact 55, down the contact arm 56, into a coil of the solenoid 38 and back to the power source battery 143. In other words, electricity can flow through the solenoid when the circuit is closed. The solenoid 38 pulls the shaft plunger 39 and the first pallet member 40 downward and the contact arm 56 moves away from the contact 55, hence breaking the circuit. Current stops flowing when the contact 55 opens up and the circuit is broken. A mechanical spring in the solenoid 38 (similar to shown in FIG. 15) pushes the shaft plunger 39 and the pallet member 40 upward and back to the original position where it started. When the contact arm 56 moves back, the contact 55 closes again and the whole process starts all over again. In this way the solenoid 38 keeps shutting itself on and off and the process repeats itself as long as current is supplied. In this case the linear movement of the shaft plunger 39 with the connected pallet member 40 is utilized to perform the incremental rotatable movement of the indexing wheel 37.

Figure 10:
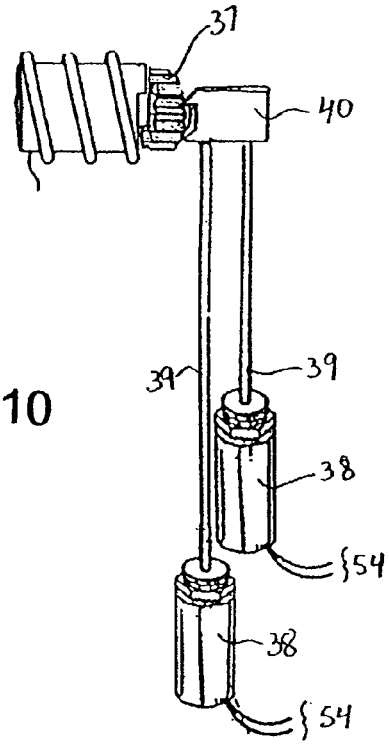
FIG. 10 is a side view of a power source provided by two electric solenoids, a pallet and a driven mechanism with an indexing wheel in accordance with third embodiment of the present invention.

In accordance with the present invention, various arrangements of mechanical drives and solenoid drives in conjunction can be utilized for the linear indexing power source. In accordance with the third embodiment of the present invention, illustrated in FIG. 10, two solenoids 38 are used and are attached by their respective shaft plungers 39 to a single shared first pallet member 40. The independent alternating push and pull forces of the combined solenoids 39 provide the linear movement of the single first pallet member 40. The first pallet member 40 incrementally drives the mating index wheel 37, causing incremental rotatory clockwise or counter-clockwise movement of the worm 36.

Figure 11:
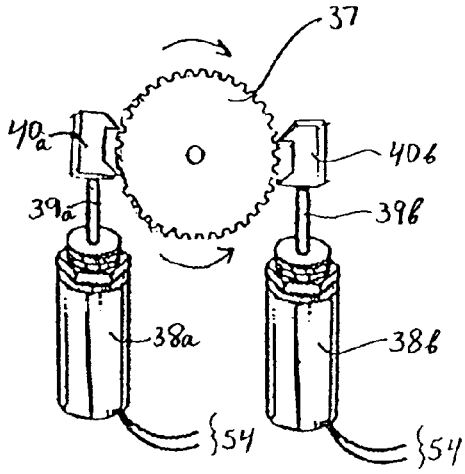
FIG. 11 shows a power source including two electric solenoids, two pallet members and a driven mechanism with an indexing wheel in accordance with the fourth embodiment of the present invention.

In accordance with the fourth embodiment of the present invention, illustrated in FIG. 11, two independently operated solenoids 38*a* and 38*b* are at opposing sides of an indexing wheel 37. The first solenoid 38*a* has a shaft plunger 39*a* connected to a first pallet member 40*a*, while the second solenoid 38*b* has a shaft plunger 39*b* connected to a second pallet member 40*b*. The independent alternating push and pull forces of each of the solenoids 38*a*, 38*b* provide the linear movement for each of the pallet members 40*a*, 40*b*. The pallet members 40*a*, 40*b* incrementally turn the mating indexing wheel 37, causing rotatory clockwise or counterclockwise movement of the worm 36. More specifically, the first solenoid 38*a* is provided to rotate the indexing wheel 37 in one direction (counterclockwise, as illustrated in FIG. 11), while the second solenoid 38*b* is provided to rotate the indexing wheel 37 in opposite direction (clockwise, as illustrated in FIG. 11).

Figure 12:
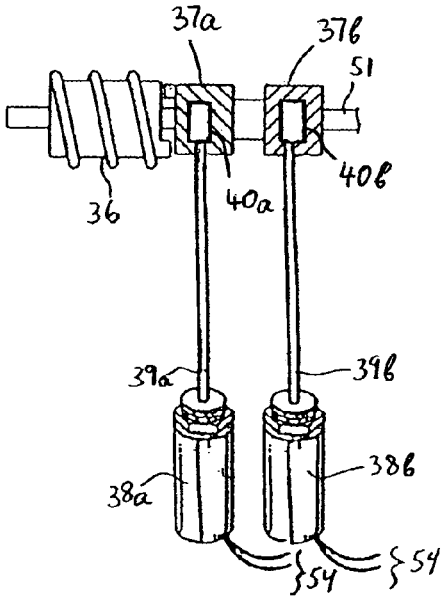
FIG. 12 is a side view of a power source provided by two electric solenoids, two push rods and a driven mechanism including two indexing wheels in accordance with the fifth embodiment of the present invention.

In accordance with the fifth embodiment of the present invention, illustrated in FIG. 12, first and second electrical solenoids 38*a* and 38*b*, respectively, are oriented in parallel to each other and independently arranged below first and second indexing wheels 37*a* and 37*b*, respectively. The first and second indexing wheels 37*a* and 37*b* share a common drive shaft 51. Each solenoid 38*a*, 38*b* has a shaft plunger 39*a*, 39*b* connected to first and second pallet members 40*a* and 40*b*, respectively. The independent alternating push and pull forces of each of the solenoids 38*a*, 38*b* provides a reciprocating (oscillating) linear movement of the shaft plungers 39*a*, 39*b*. The first and second pallet members 40*a*, 40*b* at distal ends of the shaft plungers 39*a*, 39*b* intermittently and reciprocatingly drive the mating index wheels 37*a* and 37*b*, causing incremental rotatory clockwise or counterclockwise movement of the worm gear 36. Specifically, the first solenoid 38*a* is provided to rotate the indexing wheel 37 in one direction (e.g. counterclockwise), while the second solenoid 38*b* is provided to rotate the indexing wheel 37 in opposite direction (e.g. clockwise).

Figure 13:
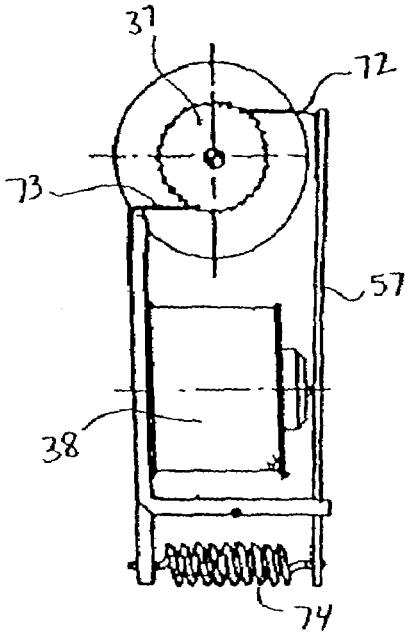
FIG. 13 is a side view of a power source provided by an electric solenoid with a spring blade ratchet and a driven mechanism with an indexing wheel in accordance with the sixth embodiment of the present invention.

In accordance with the sixth embodiment of the present invention, illustrated in FIG. 13, a spring blade ratchet utilizes a solenoid 38, a spring blade 57, a drive pawl 72 in the form of a flat spring, and holding pawl 73 for controlling the movement of the indexing wheel 37. A coil spring 74 is provided for biasing the spring blade 57 to a position away from the indexing wheel 37 and the solenoid 38. In other words, the coil spring 74 is used to return the spring blade 57 to its original position when the circuit for the solenoid 38 is open.

In operation, when the solenoid 38 is activated, it attracts the spring blade 57 so that the drive pawl 72 pushes one of teeth of the indexing wheel 37 such as to turn the indexing wheel 37 to a certain predetermined angle. During this movement both the drive pawl 72 and the spring blade 57 bend. After that the solenoid 38 is deactivated and the spring blade 57 retracts to its original position away from the indexing wheel 37 and the solenoid 38, while at the same time the drive pawl 72 and the spring blade 57 straighten. Next, the cycle repeats.

Figure 14:
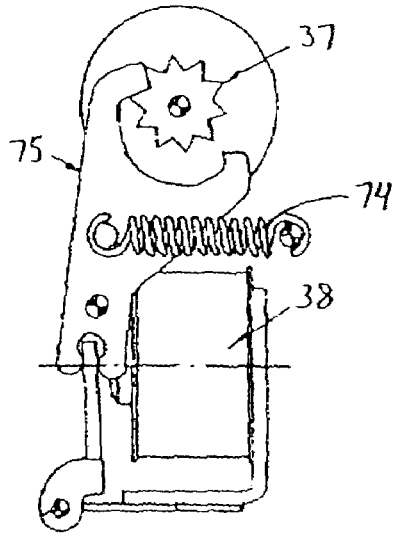
FIG. 14 is a side view of a power source provided by an electric solenoid with an inverse escapement and a driven mechanism with an indexing wheel in accordance with the seventh embodiment of the present invention.

The seventh embodiment of the present invention, illustrated in FIG. 14 is an inverse escapement similar to the embodiment of FIG. 13, whereas a solenoid 38 activates a mechanical verge arm 75 to an indexing wheel 37. A mechanical spring 74 is used to return the verge arm 75 to its original position when the circuit for the solenoid 38 is open.

Figure 15:
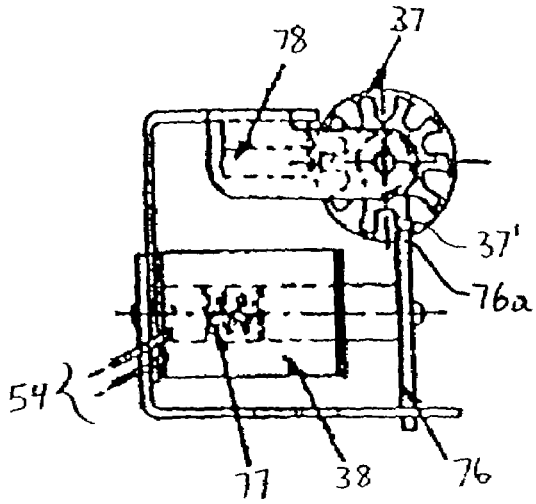
FIG. 15 is a side view of a power source provided by a magnetic ratchet and a driven mechanism with an indexing wheel in accordance with the eighth embodiment of the present invention.

In accordance with the eighth embodiment of the present invention, illustrated in FIG. 15, the drive mechanism comprises a magnetic ratchet that utilizes an electric solenoid 38. More specifically, when solenoid 38 is energized a soft-iron pole-piece 76 magnetically fastens (couples) to one of soft-iron teeth 37' of an indexing wheel 37, as a distal end 76*a* of the soft-iron pole-piece 76 is disposed adjacent to at least one of the teeth 37' of the indexing wheel 37. At the same time, as the pole-piece 76 of the solenoid 38 moves, the tooth 37' of the indexing wheel 37 follows the pole-piece 76 due to the magnetic coupling (attraction) between the tooth 37' and the pole-piece 76. Thus, the pole-piece 76 turns the indexing wheel 37 when the solenoid 38 is energized, and the wheel indexes. When the solenoid 38 is de-energized (turned off), a compression spring 77 retracts the pole-piece 76 to its initial position to meet the next tooth 37', while a permanent magnet 78 holds (retains or prevents from rotation) the indexing wheel 37.

Figure 16:
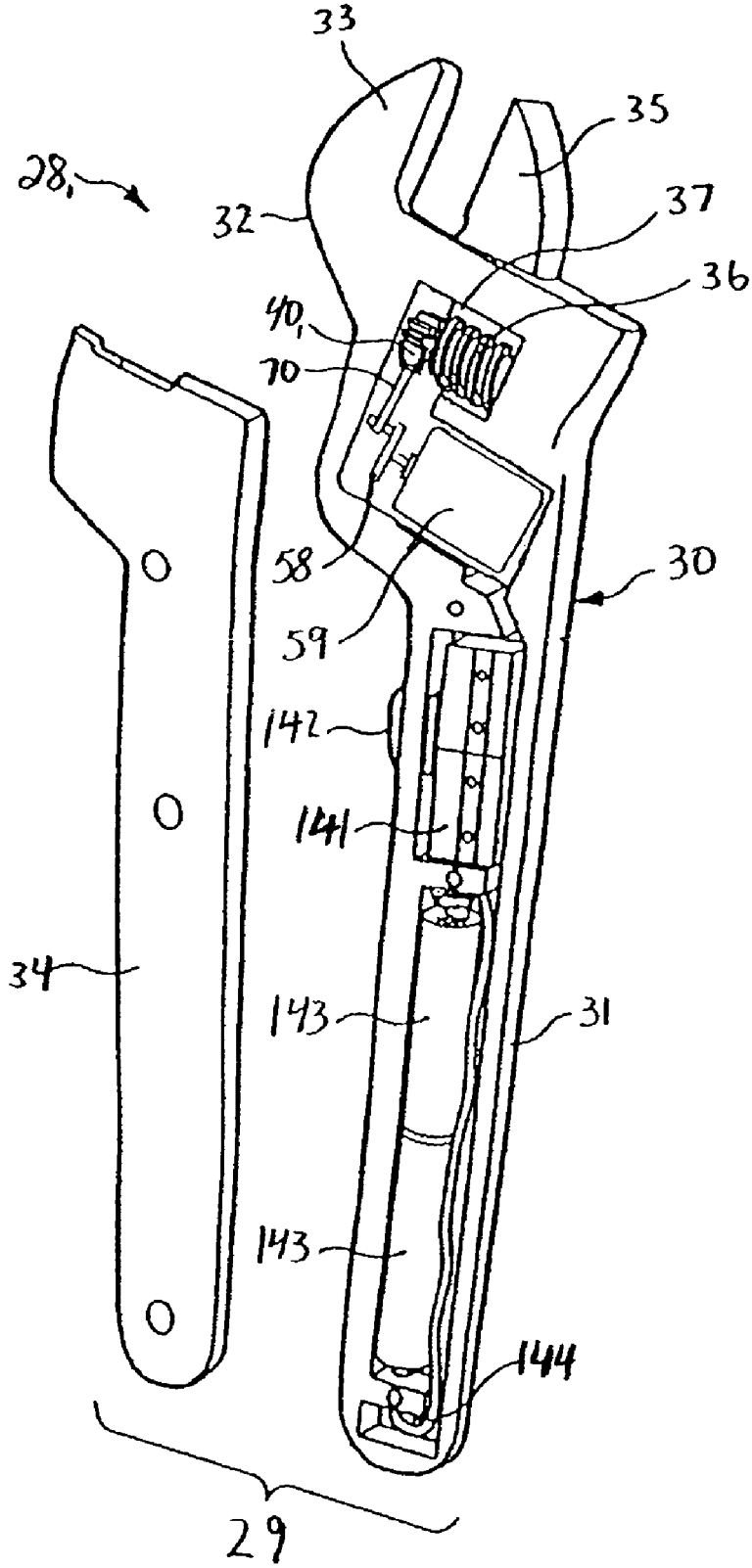
FIG. 16 is a perspective view showing an index driven powered adjustable jaw wrench in accordance with the ninth embodiment of the present invention.

It will be appreciated that the drive mechanism of the present invention may include various types of motors and various types of indexing mechanisms. FIG. 16 shows a powered adjustable wrench generally denoted by the reference numeral $\mathbf{28}_1$, in accordance with the ninth embodiment of the present invention. The powered adjustable wrench $\mathbf{28}_1$, comprises a reversible motor 59 and a crank 58.

Figure 17:
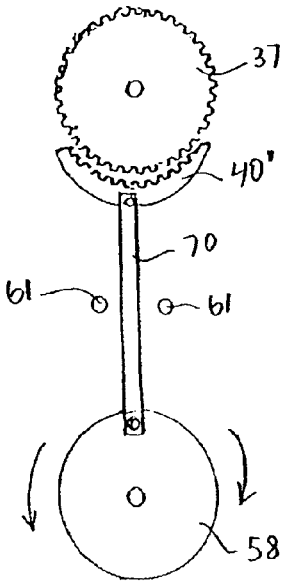
FIG. 17 is a side view of a power source provided by a reversible motor, a crank slider with a connecting pallet and a driven mechanism including an indexing wheel in accordance with the ninth embodiment of the present invention.

As illustrated in detail in FIG. 17, the crank 58 is connected to a pallet member 40' through a crank arm 70. The crank arm 70 is pivotally connected to both the crank 58 and the pallet member 40' at opposite distal ends thereof As the crank 58 turned by the motor 59, the crank arm 70 moves upward and downward in an oscillating motion. The oscillating motion of the crank arm 70 is guided by banking pins 61 provided on opposite sides of the crank arm 70 for guiding the oscillating movement thereof. During the oscillating movement of the crank arm 70, the pallet member 40' pivots and intermittently engages and drives (pulls) the indexing wheel 37. Intermittent pulling of the indexing wheel 37 incrementally rotates the worm gear 36. Depending on the rotation of the motor 59, the transmitted oscillating movement from the pallet 40' to the indexing wheel 37 will provide either clockwise or counter clockwise rotation of the worm 36.

As further illustrated in FIG. 16, the reversible electric motor 59 is electrically connected to a control switch assembly 141 including a switch actuator 142, controlling the electric motor 59 and at least one electric battery 143 supplying electric power to the electric motor 59 and the control switch assembly 141. Preferably, two batteries 143 are provided. The batteries 143 may be rechargeable. In this case, a DC power jack 144 is used for recharging the batteries 143. The electric motor 59, the control switch assembly 141 and the electric battery 143 are disposed in compartments 46, 47 and 48 respectively, formed in a handle portion 31 of a wrench body member 30, as illustrated in FIG. 5. A handle cover 34 is adapted to seal the compartments 46, 47 and 48.

Figure 18:
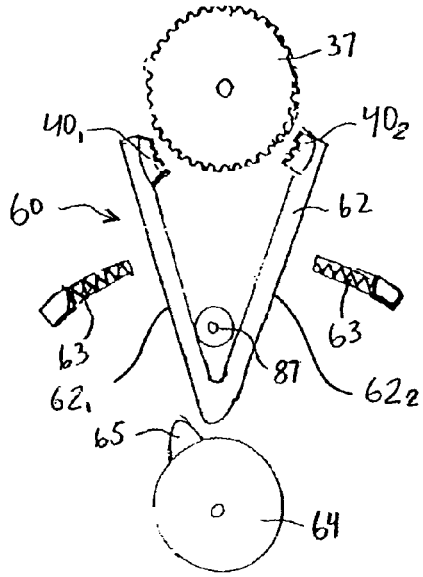
FIG. 18 is a side view of a power source provided by a reversible motor, a cam, a pivoting pallet and a driven mechanism including an indexing wheel in accordance with the tenth embodiment of the present invention.

In accordance with the tenth embodiment of the present invention, illustrated in FIG. 18, an indexing mechanism 60 comprises a rotatable cam member 64 with an integral cam lobe 65 and a pivoting V-shaped pallet body 62 having first and second pallet arms $\mathbf{62}_1$ and $\mathbf{62}_2$, respectively, oriented at an angle to each other. The cam member 64 is rotatably driven by a reversible motor (such as a reversible motor 59 shown in FIG. 16). The pallet body 62 is provided with a first pallet member $\mathbf{40}_1$ mounted to a distal end of the first pallet arm $\mathbf{62}_1$ and a second pallet member $\mathbf{40}_2$ mounted to a distal end of the second pallet arms $\mathbf{62}_2$.

In operation, as the reversible motor 59 rotates the cam member 64, the integral cam lobe 65 strikes one of the pallet arms $\mathbf{62}_1$, $\mathbf{62}_2$ of the pallet body 62 causing the pallet body 62 to reciprocate and sway back and fourth from a pivot point 87. As a result of such an orbital motion, at least one of the pallet members $40_1$ and $40_2$ engages with the indexing wheel 37. Travel distance of the pallet arms $62_1$ and $62_2$ is controlled and limited by the two spring stops 63 provided on opposite sides of the pallet body 62 for controlling the oscillating movement thereof. The movement of pallet members $40_1$ and $40_2$ provides the indexing of the indexing wheel 37 for both clockwise and counter clockwise rotation of the worm gear 36 depending on the rotational direction of the cam member 64. In other words, rotation of the cam member 64 causes the pallet body 62 to pivotally oscillate so that the first and second pallet members $40_1$ and $40_2$ drive the indexing wheel 37 by intermittently engaging the indexing wheel 37 so as to convert the oscillating movement of the first and second pallet members $40_1$ and $40_2$ into the intermittent (discrete) rotatable movement of the indexing wheel 37.

Figure 19:
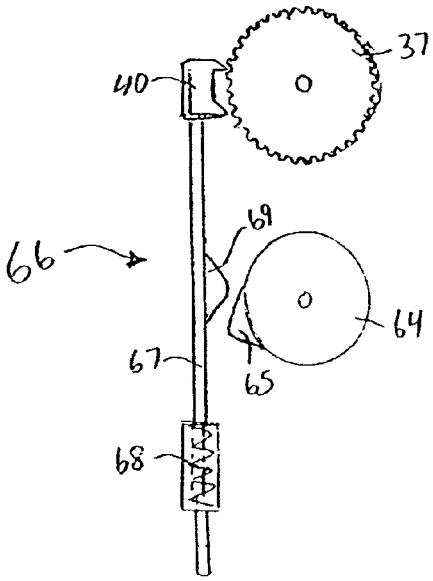
FIG. 19 is a side view of a power source provided by a reversible motor, a cam, a push rod with a connecting pallet and a driven mechanism including an indexing wheel in accordance with the eleventh embodiment of the present invention.

In accordance with the eleventh embodiment of the present invention, illustrated in FIG. 19, an indexing mechanism comprises a rotatable cam member 64 with a cam lobe 65 and a push rod assembly 66. In turn, the pushrod assembly 66 includes a laterally flexible push rod 67 with an integral cam lobe 69, a return spring 68 and a pallet member 40. Whereas, a reversible motor 59 is utilized to rotate the cam member 64 and where the integral cam lobe 65 strikes the cam lobe 69 of the push rod 67 moving the push rod 67 in a linear upward or downward movement causing the pallet member 40 to intermittently engage with the indexing wheel 37. The push rod 67 is returned to its original position by the return spring 68. The movement of the pallet member 40 provides the intermittent rotatable movement (indexing) of the index wheel 37 for both clockwise and counter clockwise rotation of the worm gear.

Figure 20:
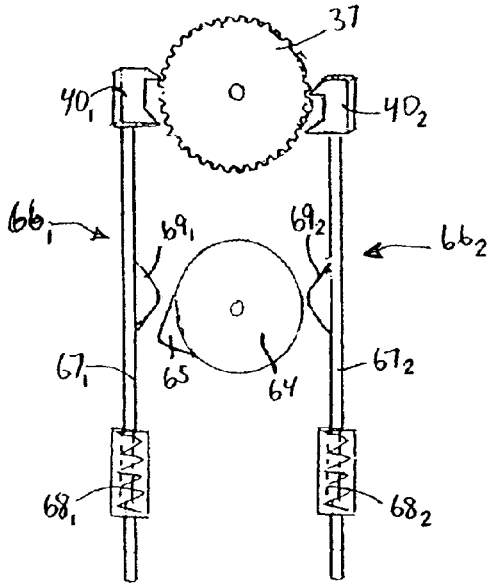
FIG. 20 is a side view of a power source provided by a reversible motor, a cam, two push rods, two pallets, and a driven mechanism including an indexing wheel in accordance with the twelfth embodiment of the present invention.

In accordance with the twelfth embodiment of the present invention, illustrated in FIG. 20, an indexing mechanism comprises a rotatable cam member 64 with a cam lobe 65 and two alternating push rod assemblies $66_1$ and $66_2$ arranged on opposite sides of an indexing wheel 37. Each of the push rod assemblies $66_1$ and $66_2$ includes a laterally flexible push rod ($67_1$, $67_2$) with an integral cam lobe ($69_1$, $69_2$), a return spring ($68_1$, $68_2$) and a pallet member ($40_1$, $40_2$) mounted to a distal end of the push rod ($67_1$, $67_2$). A reversible electric motor 59 is utilized to rotate the cam member 64 to activate each of the push rod assemblies $66_1$ and $66_2$ independently of each other. Similarly to the embodiment of FIG. 19, the movement of each of the push rod assemblies $66_1$ and $66_2$ alternately moves each pallet member ($40_1$, $40_2$) to engage with the opposite sides of the index wheel 37 and provides the intermittent rotatable movement (indexing) of the index wheel 37 for both clockwise and counter clockwise rotation of the worm gear.

Figure 21:
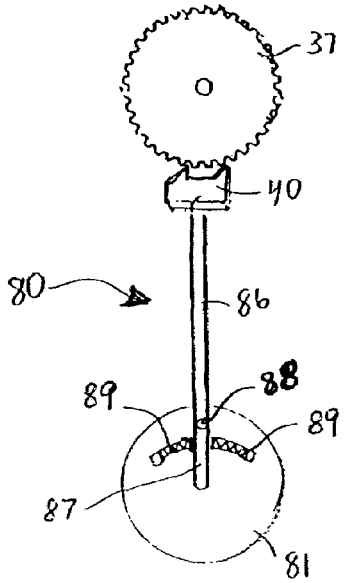
FIG. 21 is a side view of a power source provided by a reversible motor, a lever actuator assembly with a connecting pallet and a driven mechanism including an indexing wheel in accordance with the thirteenth embodiment of the present invention.
Figure 22:
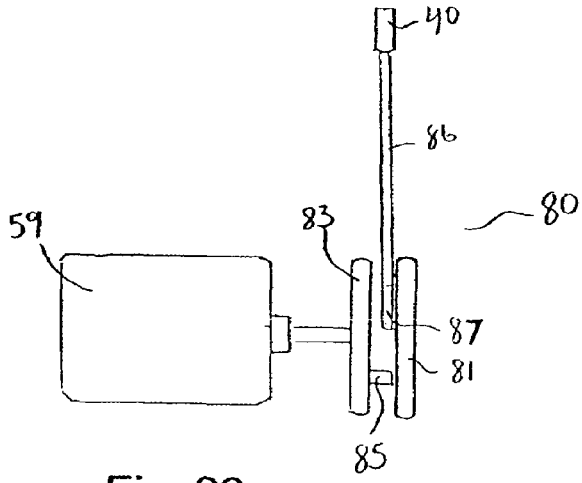
FIG. 22 is another side view of a power source provided by a reversible motor, a cam, and a lever actuator assembly with a connecting pallet in accordance with the thirteenth embodiment of the present invention.

In accordance with the thirteenth embodiment of the present invention, illustrated in FIG. 21, an indexing mechanism 80 includes a rotatable cam member 83 (shown in FIG. 22), an oscillating rod member 86 pivotally driven by the cam member 83, and a pallet member 40 mounted to a distal end of the oscillating rod member 86. The rod member 86 is pivotally attached at a pivot point 88 to a backer plate 81. The lower portion and smallest length of the rod member 86 below the pivot point 88 is defined as a lever 87. A reversible motor 59 drives the cam member 83 having an integral striker 85. The striker 85 is utilized to pivot the lever 87 of the rod member 86. The indexing mechanism 80 further including two spring stops 89 provided on opposite sides of the oscillating rod member 86 for controlling the pivoting movement thereof. In operation, the reversible motor 59 with the attached cam member 83 pivotally oscillates the lever 87 of the rod member 86. Travel distance of the lever 87 is controlled and limited by the two spring stops 89 as shown in FIG. 21. When the lever 87 is moved, the pallet member 40 intermittently engages with the indexing wheel 37 and provides the intermittent rotatable movement (indexing) of the indexing wheel 37 for both clockwise and counter clockwise rotation of the worm gear depending on the rotational direction of the motor 59.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A powered adjustable jaw wrench comprising:

a wrench body including a wrench body member having a handle portion and a head portion, said head portion defining a stationary jaw;

a movable jaw reciprocally mounted to said head portion of said body member in alignment with said stationary jaw, said movable jaw including a gear rack portion;

a driven mechanism mounted to said head portion of said body member, said driven mechanism being operably connected to said movable jaw and causing movement of said movable jaw relative to said stationary jaw, said driven mechanism including:

a worm gear rotatably mounted in said head portion of said body member, said worm gear engaging said gear rack portion of said movable jaw; and a first indexing wheel operably connected to said worm gear; and a drive mechanism mounted to said body member and including a power source and an indexing mechanism;

said indexing mechanism driven by said power source and including an oscillating first pallet member, said first pallet member incrementally driving said first indexing wheel so as to convert an oscillating movement of said first pallet member into an incremental rotatable movement of said first indexing wheel.

2. The powered adjustable jaw wrench as defined in claim 1, wherein said power source includes a single electromagnet provided for linearly driving said first pallet member.

3. The powered adjustable jaw wrench as defined in claim 1, wherein said power source includes first and second electromagnets both provided for linearly driving said first pallet member.

4. The powered adjustable jaw wrench as defined in claim 3, wherein said first electromagnet exerts a push force to said first pallet member, and wherein said second electromagnet exerts a pull force to said first pallet member.

5. The powered adjustable jaw wrench as defined in claim 1, wherein said power source includes first and second electromagnets and said drive mechanism further includes a second pallet member so that said first electromagnet drives said first pallet member and said second electromagnet oscillatingly drives said second pallet member.

6. The powered adjustable jaw wrench as defined in claim 5, wherein both said first and second pallet members operatively engage said first indexing wheel so that oscillating movements of said first and second pallet members cause a rotatable movement of said first indexing wheel.

7. The powered adjustable jaw wrench as defined in claim 5, further comprising a second indexing wheel operably connected to said worm gear; said second pallet member intermittently engages said second indexing wheel so that the oscillating movement of said second pallet member causes a rotatable movement of said second indexing wheel.

8. The powered adjustable jaw wrench as defined in claim 1, wherein said power source includes an electromagnet, and wherein said first pallet member includes a drive pawl; said drive pawl is driven by said electromagnet.

9. The powered adjustable jaw wrench as defined in claim 8, wherein said drive pawl operatively engages said first indexing wheel when said solenoid is activated and disengages said first indexing wheel when said electromagnet is deactivated.

10. The powered adjustable jaw wrench as defined in claim 8, wherein said first pallet member further includes a holding pawl in contact with said when said electromagnet.

11. The powered adjustable jaw wrench as defined in claim 8, wherein said drive pawl operatively engages said first indexing wheel when said electromagnet is deactivated and engages said first indexing wheel when said electromagnet is activated.

12. The powered adjustable jaw wrench as defined in claim 2, wherein said electromagnet is a linear electromagnetic solenoid, and wherein said first pallet member is coupled to a distal end of a pole piece of said solenoid.

13. The powered adjustable jaw wrench as defined in claim 12, wherein said pole piece is biased by a spring member.

14. The powered adjustable jaw wrench as defined in claim 1, further including a magnet member holding said first indexing wheel from rotation when said first indexing wheel is not acted upon by said first pallet member.

15. The powered adjustable jaw wrench as defined in claim 1, wherein said power source includes a reversible electric motor, a crank member rotatably driven by said electric motor and a crank arm drivingly connecting said crank member to said first pallet member so that the rotatable movement of said crank member causes the oscillating movement of said first pallet member.

16. The powered adjustable jaw wrench as defined in claim 15, further including banking pins provided on opposite sides of said crank arm for guiding the oscillating movement thereof.

17. The powered adjustable jaw wrench as defined in claim 15, wherein said first pallet member is pivotally mounted at a distal end of said crank arm.

18. The powered adjustable jaw wrench as defined in claim 1, wherein said indexing mechanism includes a rotatable cam member and a V-shaped pallet body having first and second pallet arms oriented at an angle to each other; said first pallet member is mounted to a distal end of said first pallet arm and a distal end of said second pallet arms is provided with a second pallet member; and wherein rotation of said cam member causes said pallet body to pivotally oscillate so that said first and second pallet members drive said first indexing wheel by intermittently engaging said first indexing wheel so as to convert the oscillating movement of said first and second pallet members into the intermittent rotatable movement of said first indexing wheel.

19. The powered adjustable jaw wrench as defined in claim 18, wherein said power source includes a reversible electric motor provided for driving said rotatable cam member.

20. The powered adjustable jaw wrench as defined in claim 18, further including two stops provided on opposite sides of said pallet body for controlling the oscillating movement thereof.

21. The powered adjustable jaw wrench as defined in claim 1, wherein said indexing mechanism includes a rotatable cam member and a first pushrod member linearly driven by said cam member; said first pallet member is mounted to a distal end of said first pushrod member; and wherein rotation of said cam member causes said first pushrod member to reciprocate so that said first pallet member incrementally drives said first indexing wheel by intermittently engaging said first indexing wheel so as to convert the reciprocating movement of said first pushrod member into the discrete rotatable movement of said first indexing wheel.

22. The powered adjustable jaw wrench as defined in claim 21, wherein said power source includes a reversible electric motor provided for driving said rotatable cam member.

23. The powered adjustable jaw wrench as defined in claim 21, wherein said first pushrod member is biased by a spring member.

24. The powered adjustable jaw wrench as defined in claim 21, wherein said indexing mechanism further includes a second pushrod member reciprocatingly driven by said cam member and a second pallet member mounted to a distal end of said second pushrod member; and wherein rotation of said cam member causes said first and second pushrod members to reciprocate so that said first and second pallet members incrementally drive said first indexing wheel by intermittently engaging said first indexing wheel so as to convert the reciprocating movement of said first and second pushrod members into the discrete rotatable movement of said first indexing wheel.

25. The powered adjustable jaw wrench as defined in claim 24, wherein each of said pushrod members is biased by a spring member.

26. The powered adjustable jaw wrench as defined in claim 1, wherein said indexing mechanism includes a rotatable cam member and an oscillating rod member pivotally driven by said cam member; said first pallet member is mounted to one of distal ends of said oscillating rod member.

27. The powered adjustable jaw wrench as defined in claim 26, further including two stops provided on opposite sides of said oscillating rod member for controlling the pivoting movement thereof.

28. The powered adjustable jaw wrench as defined in claim 26, wherein said oscillating rod member is pivotal about a pivot point disposed on said oscillating rod member between said distal ends thereof.

29. The powered adjustable jaw wrench as defined in claim 1, wherein said first indexing wheel comprises of a plurality of teeth axially extending therefrom coaxially with an axis of rotation of said first indexing wheel; said first pallet member intermittently engages said teeth of said first indexing wheel in order to convert the oscillating movement of said first pallet member into the discrete rotatable movement of said first indexing wheel.

30. The powered adjustable jaw wrench as defined in claim 1, wherein said first indexing wheel comprises of a plurality of teeth radially extending therefrom; said first pallet member intermittently engages said teeth of said first indexing wheel in order to convert the oscillating movement of said first pallet member into the discrete rotatable movement of said first indexing wheel.

31. The powered adjustable jaw wrench as defined in claim 1, wherein said first indexing wheel comprises of a plurality of recesses circumferentially formed on an outer peripheral surface thereof, said first pallet member intermittently engages said recesses of said first indexing wheel in order to convert the oscillating movement of said first pallet member into the discrete rotatable movement of said first indexing wheel.

32. The powered adjustable jaw wrench as defined in claim 1, wherein said power source includes an electromagnet and an armature rod provided to be driven by said electromagnet between first and second positions, said first pallet member coupled to a distal end of said armature rod.

33. The powered adjustable jaw wrench as defined in claim 32, wherein said indexing mechanism further includes an electrical contact controlling an electric current through said electromagnet so that in said first position said contact is closed to activate said electromagnet and in said second position said contact is open to deactivate said electromagnet; and wherein when in said first position, said electromagnet is activated to move said armature rod from said first position to said second position; and wherein when in said second position, said electromagnet is deactivated so that said armature rod moves from said second position to said first position.

34. The powered adjustable jaw wrench as defined in claim 33, wherein said indexing mechanism further includes a spring member biasing said armature rod to said first position and provided to move said armature rod from said second position to said first position.

35. The powered adjustable jaw wrench as defined in claim 34, wherein said armature rod is in the form of a spring blade operating as said spring member; and wherein said armature rod is pivotally moving toward said second position when said electromagnet is activated.

36. The powered adjustable jaw wrench as defined in claim 34, wherein said spring member is in the form of a compression spring; and wherein said armature rod is linearly moving along said electromagnet between said first and second positions.

37. The powered adjustable jaw wrench as defined in claim 1, wherein said drive mechanism comprises a magnetic ratchet that includes an electric solenoid and said first pallet member in the form of a soft-iron pole-piece energized by said solenoid, and wherein said first indexing wheel includes a plurality of soft-iron teeth; a distal end of said soft-iron pole-piece is disposed adjacent to at least one of said teeth of said first indexing wheel; upon energizing said solenoid said pole-piece magnetically couples to one of said soft-iron teeth of said indexing wheel so that oscillating movement of said pole-piece incrementally turns said first indexing wheel due to the magnetic attraction between said soft-iron teeth and said pole-piece.

38. The powered adjustable jaw wrench as defined in claim 37, wherein said drive mechanism further comprises a spring provided to retract said pole-piece to its initial position to meet the next tooth of said first indexing wheel when said solenoid is de-energized.

39. The powered adjustable jaw wrench as defined in claim 37, further comprising a permanent magnet that prevents said first indexing wheel from rotation when said solenoid is de-energized.

40. The powered adjustable jaw wrench as defined in claim 1, further comprising an anti-jamming coupling device provided for operably connecting said first indexing wheel to said worm gear and for upsetting said worm gear if jammed by striking action when said powered adjustable jaw wrench is activated.

* * * * *